US008010031B2

(12) United States Patent
Hayashi

(10) Patent No.: US 8,010,031 B2
(45) Date of Patent: Aug. 30, 2011

(54) IMAGE HEATING APPARATUS AND RECORDING MATERIAL CONVEYANCE APPARATUS

(75) Inventor: Yasuhiro Hayashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 444 days.

(21) Appl. No.: 12/247,936

(22) Filed: Oct. 8, 2008

(65) Prior Publication Data

US 2009/0092425 A1 Apr. 9, 2009

(30) Foreign Application Priority Data

Oct. 9, 2007 (JP) ..... 2007-263026

(51) Int. Cl.
*G03G 15/20* (2006.01)

(52) U.S. Cl. ..... 399/329; 399/67

(58) Field of Classification Search ..... 399/67, 399/329, 320, 162, 303, 313
See application file for complete search history.

(56) References Cited

U.S. PATENT DOCUMENTS

| | | | | |
|---|---|---|---|---|
| 2006/0083562 | A1* | 4/2006 | Matsumoto et al. | 399/329 |
| 2006/0133869 | A1* | 6/2006 | Sata | 399/329 |
| 2007/0059061 | A1* | 3/2007 | Katayama et al. | 399/329 |
| 2008/0003028 | A1* | 1/2008 | Kuroki et al. | 399/329 |

FOREIGN PATENT DOCUMENTS

| | | |
|---|---|---|
| JP | 2001-194922 | 7/2001 |
| JP | 2002-220107 | 8/2002 |
| JP | 2004-341346 | 12/2004 |
| JP | 2006-133399 | 5/2006 |
| JP | 2006-178309 | 7/2006 |

* cited by examiner

*Primary Examiner* — Sophia S Chen
(74) *Attorney, Agent, or Firm* — Canon USA Inc IP Division

(57) ABSTRACT

A fixing apparatus which fixes a toner image at a nip portion formed by a belt member and a rotating member controls a deviation of a belt by changing an inclination of a belt supporting member during a fixing operation. During a standby operation in which the belt member and the rotating member are separated from each other, the fixing apparatus stops changing the inclination of the belt supporting member and regulates the deviation of the belt by contacting a flange provided at the belt supporting member and a belt end portion.

3 Claims, 9 Drawing Sheets

IMAGE HEATING APPARATUS AND RECORDING MATERIAL CONVEYANCE APPARATUS

BACKGROUND OF THE INVENTION

1. Field of the Invention

The present invention relates to a belt conveyance apparatus which regulates a deviation of a belt member during rotation thereof and an image heating apparatus which heats a recording material which carries a toner image while the recording material is pinched in a nip portion and conveyed by a belt.

2. Description of the Related Art

An image forming apparatus such as an electrophotographic apparatus or electrostatic recording apparatus forms an image by forming a toner image on a sheet, and heating and pressurizing the toner image to fix the image on the sheet. For such a fixing apparatus serving as an image heating apparatus, a roller fixing type is conventionally adopted, in which a pressurizing roller is in pressure contact with a fixing roller having a heater therein to form a fixing nip for fixing.

To achieve high image gloss and high-speed image formation, time that a sheet takes to pass through the nip needs to be increased and a toner needs to be sufficiently melted. However, in a case of the roller fixing type apparatus, a roller diameter must be increased to satisfy the above condition, resulting in enlarging the apparatus.

Accordingly, a belt fixing type apparatus capable of attaining a sufficient nip width (length in a sheet conveyance direction) while satisfying miniaturization and high-speed operation of the apparatus is discussed (Japanese Patent Application Laid-Open No. 2004-341346). The belt fixing type apparatus is provided with a fixing belt and a pressurizing belt facing each other and is structured to perform fixing while pinching and conveying a sheet between the both belts, so that the belt fixing type apparatus can attain a sufficiently larger nip width than the roller fixing type apparatus.

In a case of the belt fixing type apparatus, if a belt meanders, the belt may drop off the roller or the belt end portion may break. Accordingly, a fixing apparatus or a conveyance apparatus using a belt member needs to have a structure configured to regulate or correct lateral deviation (meandering) of the belt. In particular, in a system using a belt, a contact pressure between a fixing belt and a pressurizing belt often increases with recent needs of high-speed operation. Accordingly, belt deviation force also increases and belt deviation control is often used to prevent the meandering of the belt and breakage of the belt end portion.

However, in the belt fixing type apparatus, the belt needs to be rotated during a standby operation in addition to a fixing operation to keep the belt in a circumferential direction at a uniform temperature. Accordingly, the belt deviation control is required during the rotation. The belt deviation control puts a stress on the belt and may cause deformation or breakage of the belt and shorten a durability life.

SUMMARY OF THE INVENTION

The present invention is directed to an image heating apparatus and a recording material conveyance apparatus which can improve durability life of a belt by regulating a deviation of the belt.

According to an aspect of the present invention, an image heating apparatus includes an endless belt configured to heat an image on a recording material, a supporting member configured to support the endless belt, a rotating member configured to contact the endless belt to form a heating nip portion where the endless belt heats the image on the recording material, a contact/separation unit configured to separate the endless belt from the rotating member, a first regulating unit configured to regulate a deviation of the endless belt in a width direction by moving at least one end of the supporting member, a second regulating unit configured to regulate the deviation of the endless belt in the width direction by contacting an end portion of the endless belt in the width direction, and a control unit configured to regulate the deviation of the endless belt in the width direction by the first regulating unit during image heating operation and to regulate the deviation of the endless belt in the width direction by the second regulating unit without actuating the first regulating unit during standby operation in which the endless belt rotates in a state that the endless belt and the rotating member are separated from each other.

According to another aspect of the present invention, a recording material conveyance apparatus includes an endless belt configured to convey a recording material, a supporting member configured to support the endless belt, a rotating member configured to contact the endless belt to form a nip portion where the endless belt conveys the recording material, a contact/separation unit configured to separate the endless belt from the rotating member, a first regulating unit configured to regulate a deviation of the endless belt in a width direction by moving at least one end of the supporting member, a second regulating unit configured to regulate the deviation of the endless belt in the width direction by contacting an end portion of the endless belt in the width direction, and a control unit configured to regulate the deviation of the endless belt in the width direction by the first regulating unit during conveyance of the recording material and to regulate the deviation of the endless belt in the width direction by the second regulating unit without actuating the first regulating unit when the recording material is not conveyed and the endless belt rotates in a state that the endless belt and the rotating member are separated from each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute apart of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Referring to the accompanying drawings, a fixing apparatus which heats and fixes a toner image using a belt is described as an example of a belt conveyance apparatus and an image heating apparatus having the belt conveyance apparatus according to exemplary embodiments of the present invention together with an image forming apparatus using the same.

First Exemplary Embodiment

First, referring to FIG. 7, a structure of an image forming apparatus is described below, along with image forming operation.

Figure 7:
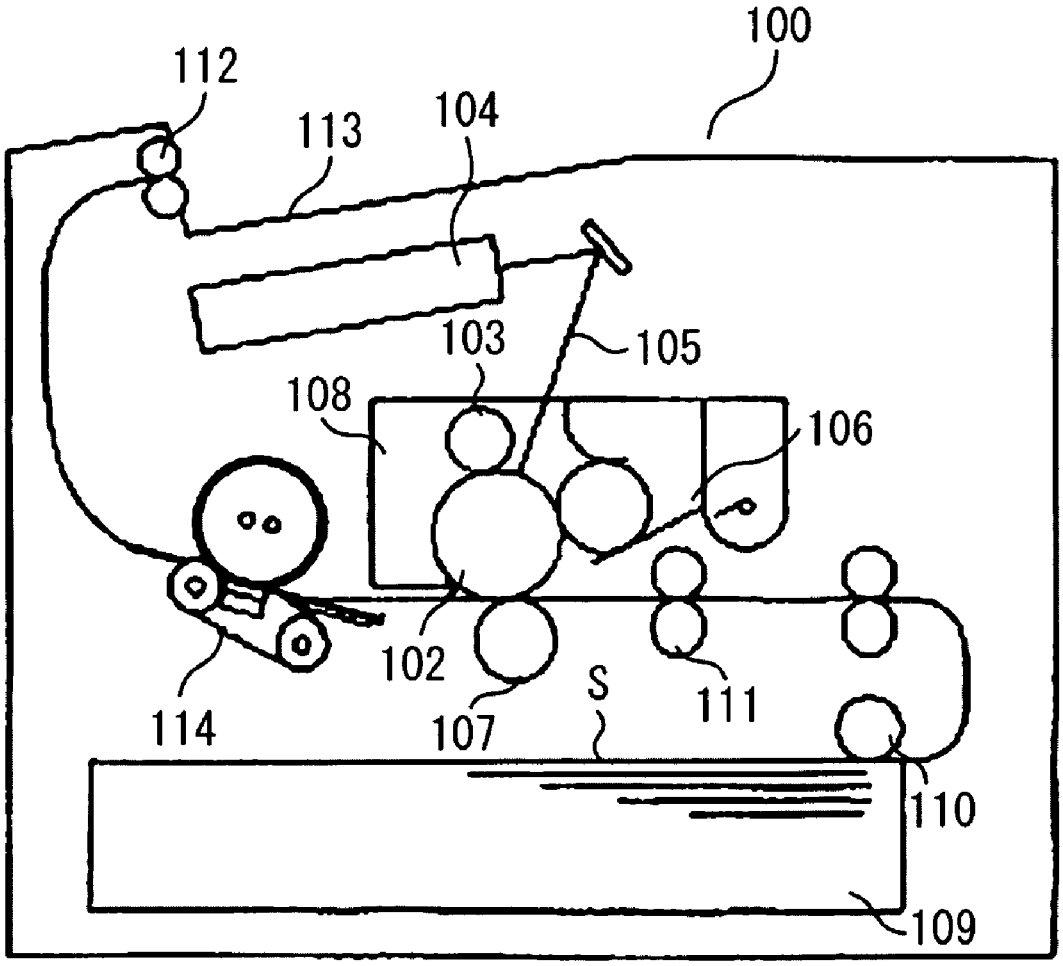
FIG. 7 is a sectional view of an image forming apparatus according to an exemplary embodiment of the present invention.
Figure 8:
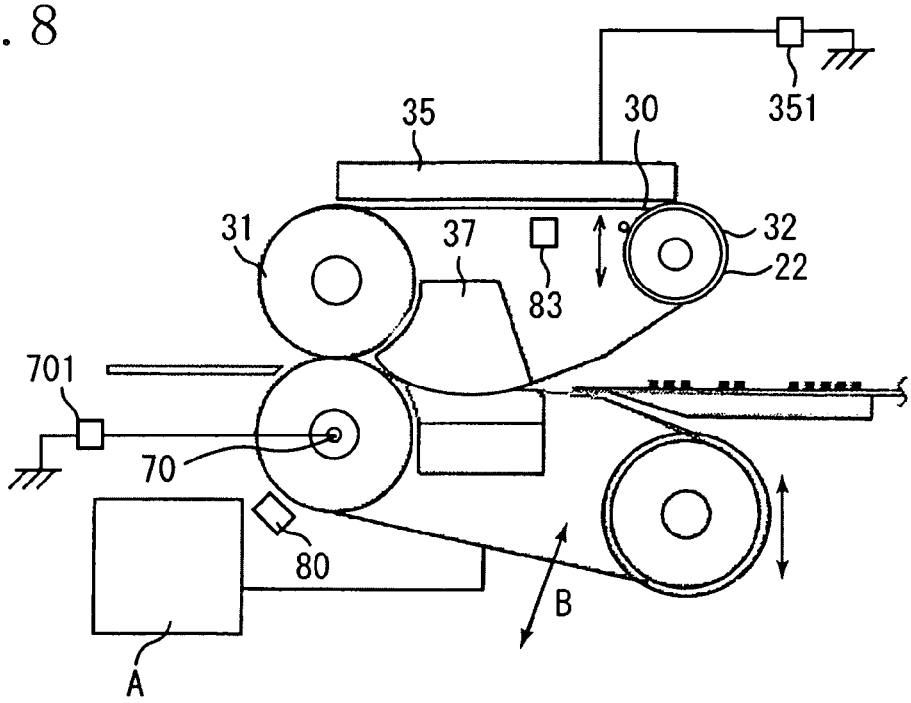
FIG. 8 is a sectional view of a fixing apparatus according to a second exemplary embodiment of the present invention.

The image forming apparatus illustrated in FIG. 7 utilizes electrophotographic technology.

The image forming apparatus 100 includes an image forming unit and a fixing apparatus. The image forming unit forms a toner image on a sheet as a recording material. The fixing apparatus as an image heating apparatus heats and pressurizes the toner image formed on the sheet and fixes the unfixed image on the sheet.

The image forming unit includes following units and devices. A charging device 103 serving as a charging unit is provided around a photosensitive drum 102 as an image carrier. When an image formation command is received, a surface of the photosensitive drum 102 is uniformly charged by the charging device 103. Then, the photosensitive drum 102 is irradiated with a laser beam 105 corresponding to the image from an exposure device 104 as an exposure unit, and an electrostatic latent image is formed on the photosensitive drum 102. The electrostatic latent image is developed by a development device 106 as a developing unit to form a toner image.

A sheet S as a recording material is stored in a sheet feed cassette 109 at a lower portion of the apparatus and fed by a sheet feed roller 110. The sheet S is conveyed synchronously with the toner image on the photosensitive drum 102 by a registration roller pair 111 as a conveyance unit.

The toner image on the photosensitive drum 102 is electrostatically transferred on the sheet S by a transfer roller 107 as a transfer unit and conveyed to a fixing apparatus 114. The toner remaining on the photosensitive drum 102 is removed by a cleaning device 108 as a cleaning unit.

The toner image formed on the sheet S by the image forming unit is heated and pressurized by the fixing apparatus 114 as an image heating apparatus and is fixed on the sheet S. Then the sheet S with the fixed toner image is conveyed and discharged onto a discharge tray 113 on the top of the apparatus by a discharge roller pair 112.

Figure 1:
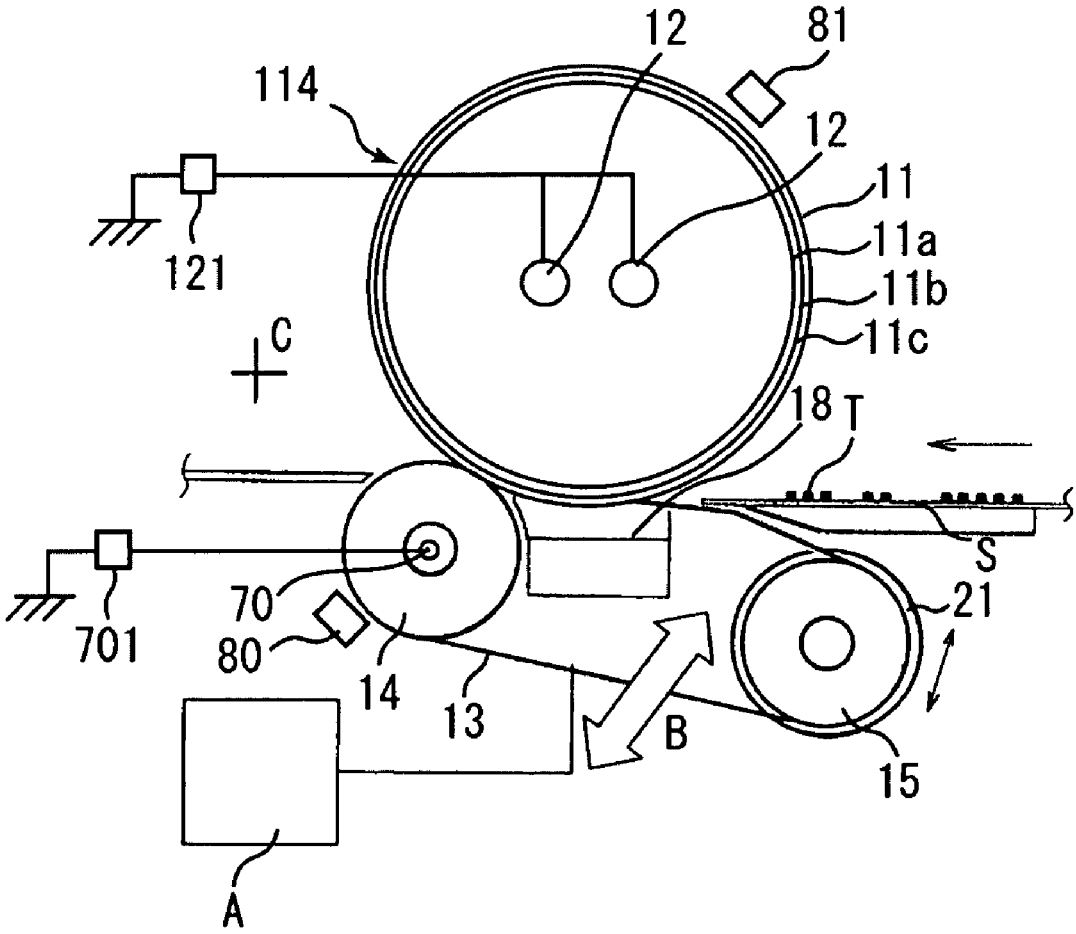
FIG. 1 is a sectional view of a fixing apparatus according to a first exemplary embodiment of the present invention.
Figure 12:
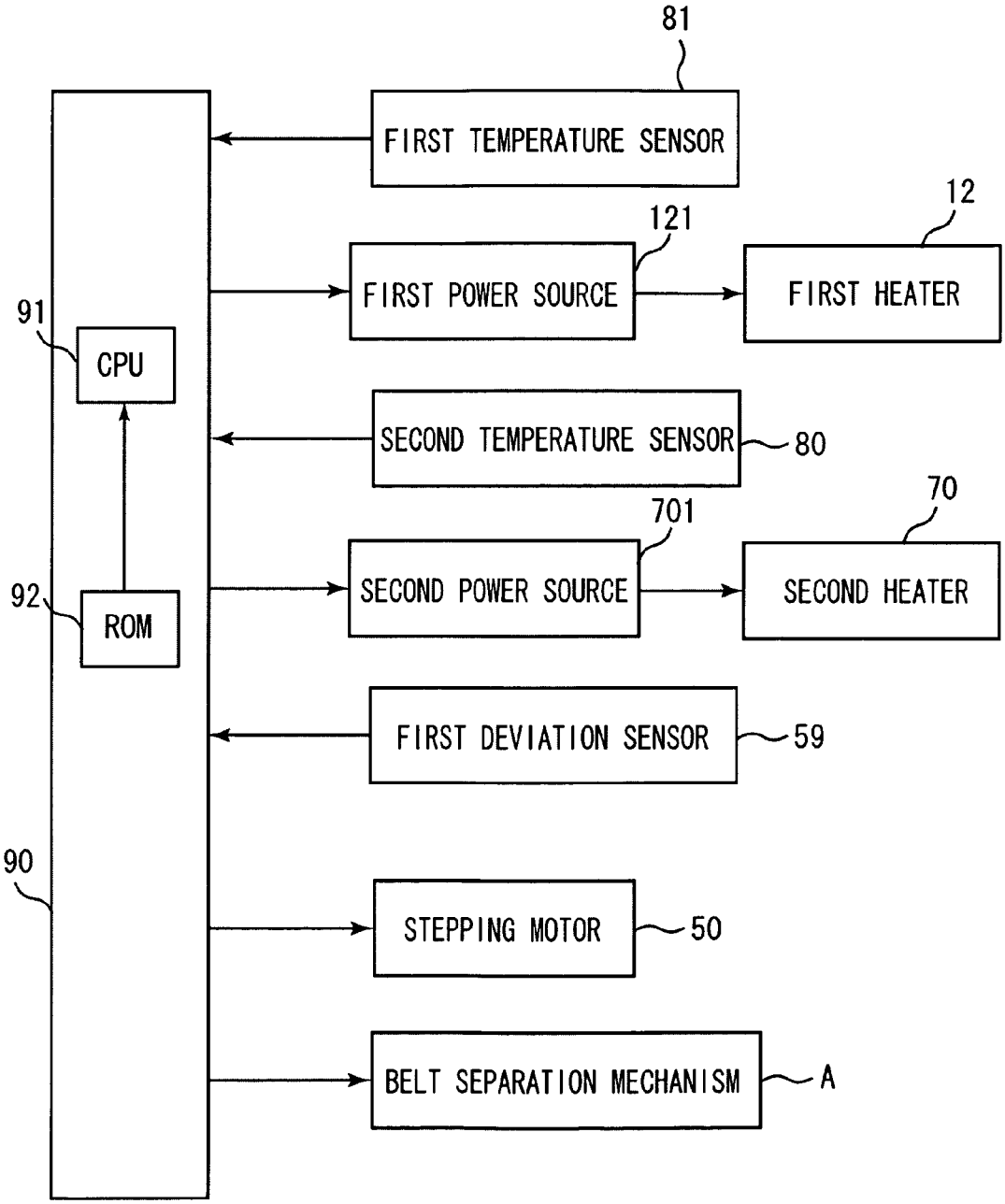
FIG. 12 is a block diagram of a control circuit in the fixing apparatus according to the first exemplary embodiment of the present invention.

Next, referring to FIGS. 1 to 4 and FIG. 12, the fixing apparatus 114 of the present exemplary embodiment is described below. FIG. 12 is a block diagram of a control circuit for implementing control of the fixing apparatus 114 of the present exemplary embodiment. As illustrated in FIG. 1, a heating roll 11 as a rotating unit applies heat generated by an internal first heater 12 to a toner T on the sheet S via an endless belt member 13, which is hereinafter referred to as a "belt", and pinches and conveys the sheet S with the belt 13. The first heater 12 is powered by a first power source 121 for heat generation. The heating roll 11 in the present exemplary embodiment has a metal core 11*a* formed of an aluminum cylindrical tube having an outer diameter of 56 mm and an inner diameter of 50 mm. The first heater 12 is incorporated in the metal core 11*a*. A surface of the metal core 11*a* is covered with an elastic layer 11*b* which is made of silicon rubber, for example, having a thickness of 2 mm and Asker C hardness of 45° and further a surface layer of the elastic layer 11*b* is covered with a heat-resistant mold release layer 11*c* which is made of tetrafluoroethylene perfluoroalkoxylvinyl ether copolymer (PFA) or polytetrafluoroethylene (PTFE).

A first temperature sensor 81 is provided for detecting a temperature of the heating roll 11. A controller 90 illustrated in FIG. 12 turns on and off an output of the first power source 121 according to the temperature detected by the first temperature sensor 81 so that the temperature of the heating roll 11 is kept at a predetermined temperature (160° C. in the present exemplary embodiment).

The belt 13 is stretched between two supporting rolls as supporting members for rotatably supporting the belt, namely a belt pressurizing roll 14 and a steering roll 15 which has a belt steering function and a belt tension applying function, so as to circulate at a predetermined tension (e.g. 100 N).

At an inside of the belt 13 corresponding to an inlet side of a nip region (upstream side of the belt pressurizing roll 14) between the heating roll 11 and the belt 13, a pressurizing pad 18 made of, for example, silicon rubber is pressed against the heating roll 11 at a predetermined pressure (e.g. 400 N), thereby forming a nip with the belt pressurizing roll 14.

The belt pressurizing roll 14 which suspends the belt 13 is formed of, for example, hollow stainless steel structure having an outer diameter of ϕ20 mm and is disposed on an outlet side of the nip region between the heating roll 11 and the belt 13 to elastically deform the elastic layer 11*b* of the heating roll 11 by a predetermined amount. A second heater 70 is disposed inside the belt pressurizing roll 14 and powered by a second power source 701 for heat generation. A second temperature sensor 80 detects the temperature of the belt 13. The controller 90 illustrated in FIG. 12 turns on and off an output of the second power source 701 according to the temperature detected by the second temperature sensor 80 so that the belt 13 is kept at a predetermined temperature (100° C. in the present exemplary embodiment).

Figure 2:
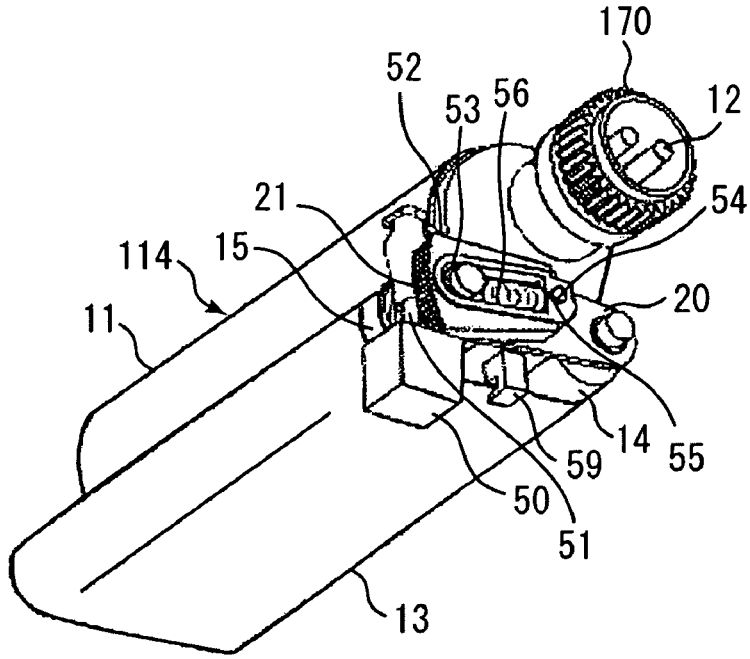
FIG. 2 is a perspective view of the fixing apparatus according to the first exemplary embodiment of the present invention.
Figure 3:
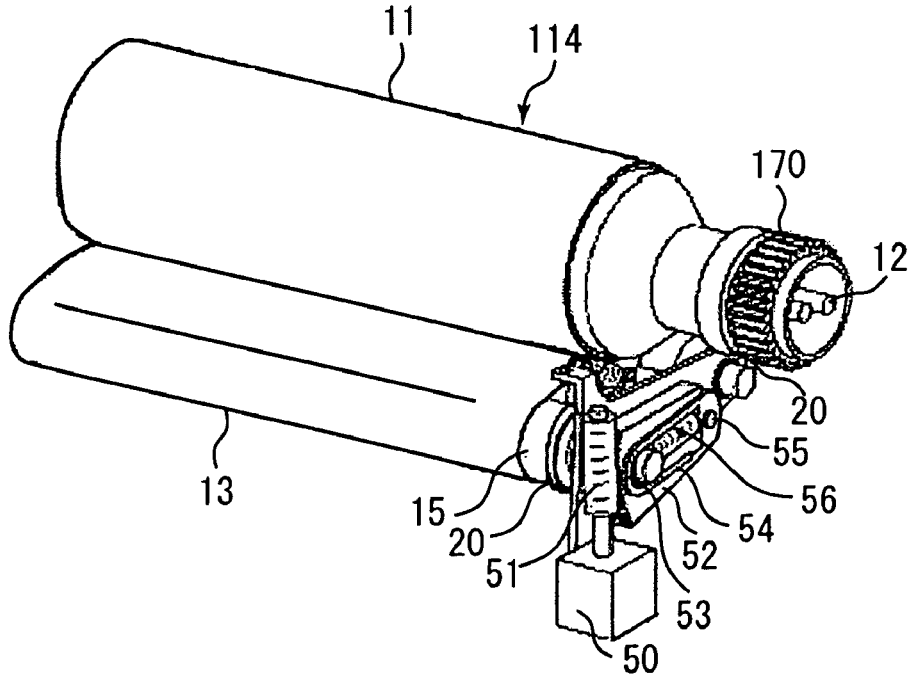
FIG. 3 is a perspective view of the fixing apparatus according to the first exemplary embodiment of the present invention.

As illustrated in FIGS. 2 and 3, a drive input gear 170 is mounted on one side edge of the heating roll 11. The drive input gear 170 receives rotary drive from a main body of the image forming apparatus 100.

The steering roll 15 is a hollow roll which is made of, for example, stainless steel having an outer diameter of approximately ϕ20 mm and an inner diameter of approximately ϕ18 mm, and serves as a steering roll for adjusting meandering of the belt 13 in a width direction orthogonal to a traveling direction of the belt 13 and also as a belt tensioning roll.

On each end of the steering roll 15, there is provided a belt flange 21 which is an abutting member as a second regulating unit for regulating a deviation of the belt 13 by abutting on a belt edge in the width-direction orthogonal to the traveling direction of the belt 13. Each belt flange 21 is fixed on each end of the steering roll 15 at a predetermined distance from a center position of the belt 13 in the width direction, so that an end position of the belt 13 is prevented from further going to the outside. The belt flange 21 has a diameter larger than a diameter of the steering roll 15 and rotates integrally with the steering roll 15. For a material of the belt flange 21, a plastic member having high heat resistance and high slidability is used.

In the present exemplary embodiment, any appropriate belt may be selected as the belt 13 as long as the material has heat resistance. In the present exemplary embodiment, a belt which is made of polyimide film of 75 μm thick, 380 mm wide and 200 mm in peripheral length and coated with, for example, silicon rubber of 300 μm thick is used.

Next, a block diagram illustrated in FIG. 12 will be described below. The controller 90 includes a central processing unit (CPU) 91 and a read-only memory (ROM) 92 storing a program for the control in the present exemplary embodiment. The controller 90 controls operation of motors and power sources based on signals received from each sensor.

The belt pressurizing roll 14, the pressurizing pad 18 and the steering roll 15 constitute a pressure unit. The pressure unit is structured so that the whole pressure unit can be rotated around a rotational center C relative to the heating roll 11 in directions of arrow B by a belt separation mechanism A as a belt contact/separation unit illustrated in FIG. 1. Accordingly, operation of the belt separation mechanism A allows a state of the pressure unit to be selected between contact and separation with/from the heating roll 11. During standby operation in which no fixing (heating) operation is performed the pressure unit is separated from the heating roll 11. In other words, during the standby operation, the belt 13 and the heating roll 11 are separated from each other. "During the standby operation" herein means a period from completion of an image formation until the image forming unit has received the image formation command for starting another image formation.

In the belt fixing type apparatus, temperature distribution of the belt 13 in a peripheral direction needs to be uniform to achieve uniform image gloss.

Accordingly, in the present exemplary embodiment, during the standby operation as well as during image fixing (heating) operation, the belt 13 separated from the heating roll 11 is rotated and, at the same time, the second heater 70 is turned on so that the belt 13 is kept at a predetermined temperature (100° C. in the present exemplary embodiment).

Similarly, during the standby operation, the heating roll 11 is rotated and, at the same time, the first heater 12 is turned on so that the heating roll 11 is kept at a predetermined temperature (160° C. in the present exemplary embodiment).

If the belt 13 and the heating roll 11 are rotated while the pressure unit is in a pressurizing state other than the image fixing (heating) operation, an internal surface of the belt 13 and the pressurizing pad 18 are worn and drive load becomes heavier which can cause problems such as slippage and short service life.

Accordingly, during the standby operation, the belt 13 is separated from the heating roll 11, that is, the pressure unit is separated from the heating roll 11 and the belt 13 is rotated at a lower speed than during the fixing (heating) operation, in order to attain longer service life.

The fixing apparatus according to the present exemplary embodiment is provided with a first regulating unit for regulating the deviation of the belt 13 by displacing, using a stepping motor 50, at least one longitudinal end of the steering roll 15 which applies tension to the belt 13. A structure of the first regulating unit is described below.

As illustrated in FIG. 3, the steering roll 15 is mounted on a steering roll supporting arm 54 rotatably and slidably in a direction that tension is applied to the belt 13 relative to the steering roll supporting arm 54. A roll bearing 53 of the steering roll 15 is urged in a direction that applies the tension to the belt 13 by a tension spring 56 which is held by the steering roll supporting arm 54.

The steering roll supporting arm 54 is supported so as to rotate around a shaft 55 which is fixed on an outside of a side plate 20. On an outer periphery of the steering roll supporting arm 54, a fan-shaped gear 52 (refer to FIG. 2) is fixed and is engaged with a worm 51 (refer to FIG. 3) which can be rotated by driving of the stepping motor 50.

In vicinity of an end portion of the belt 13 in the width direction, there is provided a first deviation sensor 59 (refer to FIG. 2) as a deviation detecting unit for detecting the deviation of the belt 13 in the width direction by detecting a belt end portion. The first deviation sensor 59 can detect five belt positions of the belt 13 in the longitudinal direction (width direction) with a single sensor.

Figure 4:
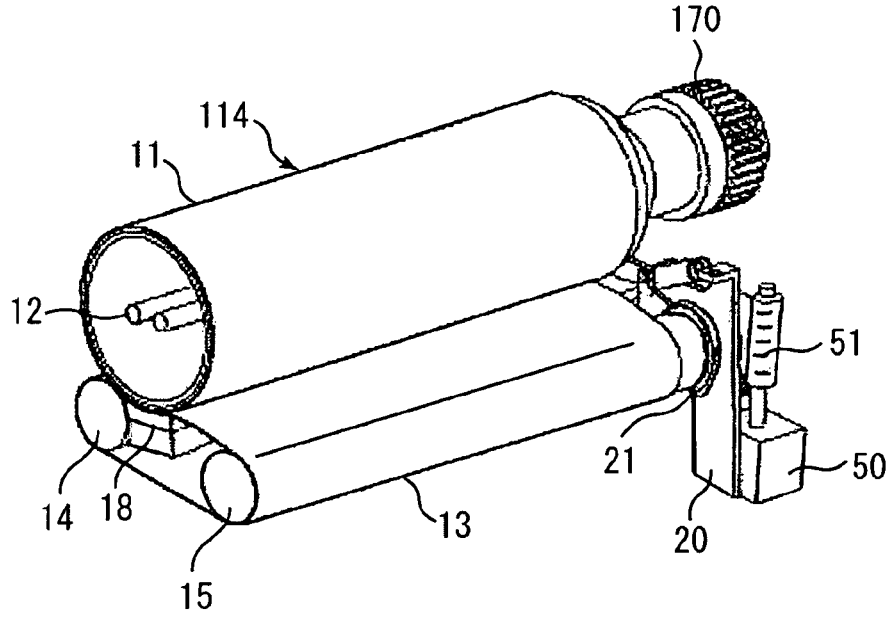
FIG. 4 is a perspective view of the fixing apparatus according to the first exemplary embodiment of the present invention.

FIGS. 2 to 4 illustrate approximately a half of the fixing apparatus 114 in the longitudinal direction (belt width direction orthogonal to the belt traveling direction). The other half has an exactly symmetrical configuration except for the drive input gear 170 and the sensor 59.

As illustrated in FIGS. 2 to 4, when the belt 13 moves to the right, the first deviation sensor 59 detects a right deviated position 1 and transmits the detected position to the controller 90 illustrated in FIG. 12. At this time, the controller 90 controls rotation of the stepping motor 50 so as to upwardly move the fan-shaped gear 52 around the shaft 55. Accordingly, the belt 13 moves in an opposite direction, specifically to the left in FIGS. 2 to 4, and the first deviation sensor 59 detects that the belt 13 has left the right deviated position 1.

Subsequently, the first deviation sensor 59 detects a left deviated position 1 and transmits the detected position to the controller 90. At this time, the controller 90 controls the rotation of the stepping motor 50 so as to downwardly move the fan-shaped gear 52 around the shaft 55. A series of repetitive control operations described above allow the belt 13 to continue stable meandering.

The other half of the fixing apparatus 114 (not illustrated in FIGS. 2 to 4) has the exactly symmetrical configuration except for the drive input gear 170 and the first deviation sensor 59 and the control operations thereof are exactly the same as described above. More specifically, the first deviation sensor 59 detects the position of the end portion of the belt 13. Based on the detected position, rotation of the stepping motor 50 is controlled so as to upwardly or downwardly move the fan-shaped gear 52 around the shaft 55.

Figure 5:
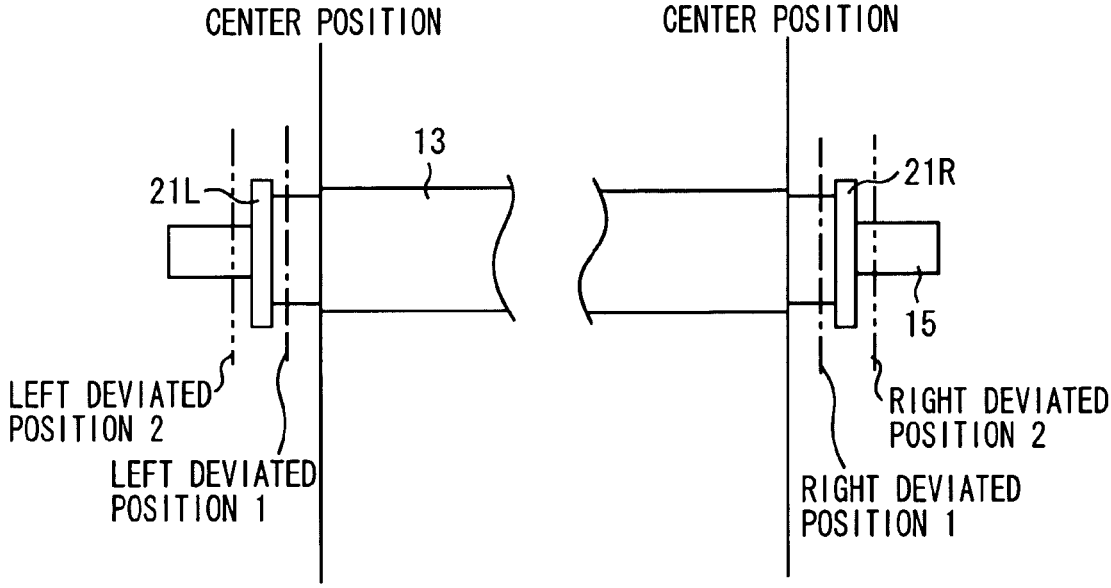
FIG. 5 illustrates relative positions of a belt, a flange and a steering.

Referring to FIG. 5, each position of the belt 13 detected by the first deviation sensor 59 and each distance relative to the belt flange 21 are described. A Relation between the detected position of the belt 13 by the first deviation sensor 59 and the distance relative to the belt flange 21 in the present exemplary embodiment is as follows:

(1) Center position (A distance between the end portion of the belt 13 and the belt flange 21L or 21R): 3 mm (2) Right deviated position 1 (A distance between the end portion of the belt 13 and the belt flange 21R): 1 mm (3) Left deviated position 1 (A distance between the end portion of the belt 13 and the belt flange 21L): 1 mm (4) Right deviated position 2 (A distance between the end portion of the belt 13 and the belt flange 21R): −2.5 mm (5) Left deviated position 2 (A distance between the end portion of the belt 13 and the belt flange 21L): −2.5 mm In order to perform deviation control of the belt 13 in the present exemplary embodiment, when the first deviation sensor 59 detects that the end portion of the belt 13 is at the right deviated position 1, the stepping motor 50 is driven so as to regulate the belt 13 to move left. On the other hand, when the first deviation sensor 59 detects that the end portion of the belt 13 is at the left deviated position 1, the stepping motor 50 is driven so as to regulate the belt 13 to move right. Such deviation control of the belt 13 causes the belt 13 to reciprocate between the right deviated position 1 and the left deviated position 1.

Figure 6:
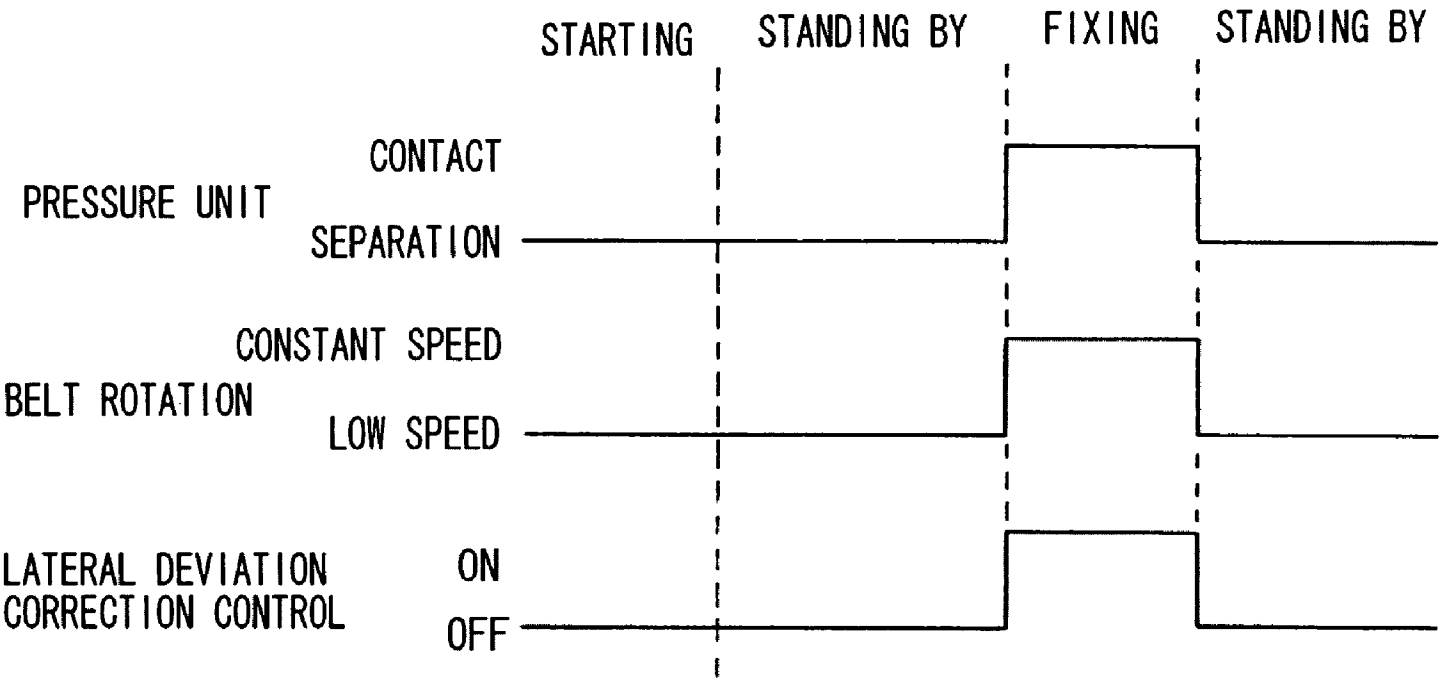
FIG. 6 is a timing chart of controlling a belt deviation.

FIG. 6 illustrates a timing chart of contact and separation operations of the pressure unit, rotational speed of a fixing device and a belt deviation control operation.

When the pressure unit is in contact with the heating roll 11, that is, during the image fixing (heating) operation, deviation force of the belt 13 is strong. Accordingly, the deviation control of the belt 13 is performed by operating the first regulating unit and displacing the rotating shaft of the steering roll 15 as described above.

However, during the standby operation other than the image fixing (heating) operation, the pressure unit is separated from the heating roll 11. At this time, the deviation force of the belt 13 is reduced to approximately 1/10 as compared to when the pressure unit is in contact with the heating roll 11. Accordingly, even if the belt 13 abuts on the belt flange 21L or the belt flange 21R which consist the second regulating unit, the belt 13 is sufficiently endurable even if the deviation control is not performed by the first regulating unit. Therefore, the deviation control by the first regulating unit can be skipped. Consequently, in the present exemplary embodiment, during the standby operation in which the pressure unit and the heating roll 11 are separated from each other, the belt deviation control by the first regulating unit described above is not implemented, but the belt deviation regulation is implemented by the second regulating unit using the belt 13 abutting on the belt flange 21.

When the image fixing (heating) operation is not performed, for example during the standby operation, sound is produced only from the fixing apparatus. Accordingly, if the deviation control of the belt 13 is implemented by the first regulating unit during the standby operation, noise will be loud. However, in the present exemplary embodiment, since the end portion of the belt 13 abuts on the belt flange 21 without any deviation control of the belt 13 by the first regulating unit during the standby operation, significant noise reduction is achieved.

The deviation control by the first regulating unit will give some stress to the belt 13 from the steering roll 15. Accordingly, elongation or cracking may occur at the belt 13 which may lead to the deviation control failure. However, the present exemplary embodiment prevents such a failure so that long-term use and higher durability are achieved.

When durability of the fixing apparatus causes disturbance to the belt deviation control, as typified by variation in a balance of right/left frictional coefficient of a belt inner surface and variation in a right/left balance of nip pressure, the end portion of the belt 13 may come into contact with the right or left belt flange 21.

Accordingly, in the present exemplary embodiment, in view of estimated external disturbance, the steering amounts of the steering roll 15 (rotational control amounts of the stepping motor 50) at the right deviated position 1 and the left deviated position 1 are defined so that an end portion strength (STRENGTH) of the belt 13 relative to a deviation force F of the belt 13 have a relationship of F<STRENGTH.

Accordingly, when the end portion of the belt 13 comes into contact with the belt flange 21, further deviation is regulated by the belt flange 21.

If the belt 13 reaches the right deviated position 2 or the left deviated position 2, that is, a position beyond the right or left belt flange 21, this means that unexpected disturbance has occurred (for example, the apparatus has processed more than a specified maximum number of sheets within durability life). In this case, some damage occurs at the end portion of the belt 13, and the whole apparatus is stopped.

By operating the apparatus as described above, stable operation of the apparatus can be achieved with a limited steering amount without damaging the belt 13.

The end portion strength S of the belt 13 can be experimentally determined by a base material and thickness of the belt 13. The end portion strength S of the belt 13 is higher when the belt 13 is made of a metal base material, and the belt 13 of larger thickness is more appropriate.

As described above, the belt deviation control by the first regulating unit is implemented only when the pressure unit is in contact with the heating roll 11. When the pressure unit is separated from the heating roll 11, the deviation control is implemented by contacting the flange 21 of the second regulating unit and the end portion of the belt 13 without implementing the belt deviation control by the first regulating unit. Accordingly, the belt 13 can attain the longer service life without noise generated when the image forming apparatus is started or in the standby operation.

Second Exemplary Embodiment

Figure 13:
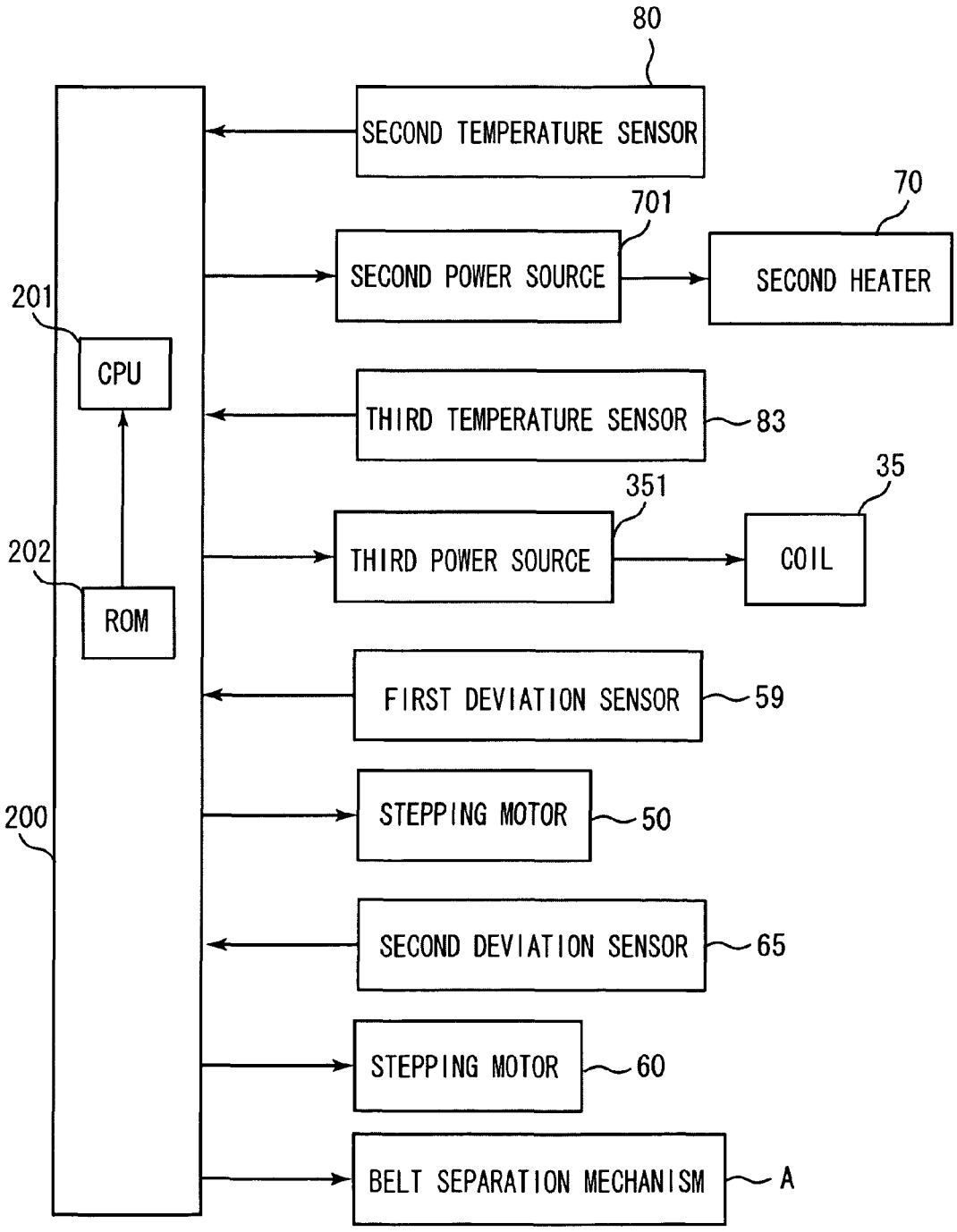
FIG. 13 is a block diagram of a control circuit in the fixing apparatus according to the second exemplary embodiment of the present invention.

Referring to FIGS. 8 to 11 and FIG. 13, an apparatus according to a second exemplary embodiment will be described below. Since the basic configuration of the apparatus in the present exemplary embodiment is the same as the foregoing exemplary embodiment, the description thereof will not be repeated and only the configuration different from that of the first exemplary embodiment will be described. Components having the same functions as those of the foregoing exemplary embodiment are assigned the same reference numerals or characters. FIG. 13 is a block diagram of a control circuit for implementing control by the fixing apparatus 115 of the present exemplary embodiment.

In the present exemplary embodiment, an endless belt member 30 is utilized (hereinafter referred to as a "belt") in place of the heating roll 11 in the first exemplary embodiment. The belt member has generally a smaller thermal capacity than the heating roll and therefore the belt member can shorten starting time of the fixing apparatus because of faster temperature rise upon start-up of the apparatus. In addition, since two belts form a pressure contact portion (nip portion), a wide nip width can be ensured, thus a high-speed operation is facilitated.

The fixing apparatus 115 according to the present exemplary embodiment includes the belt 13, the belt flanges 21 as the second regulating unit, the first deviation sensor 59 and the first regulating unit for regulating the deviation of the belt 13, which are as described in the first exemplary embodiment.

In addition, the belt 30 as a rotating unit which can contact with and separate from the belt 13, a second deviation sensor 65 for detecting a deviation of the belt 30 and the first regulating unit for regulating the deviation of the belt 30 are provided. Further, there is also provided the belt flange 22 as the second regulating unit which regulates the deviation of the belt 30 by contacting with the edge of the belt 30 in a width direction.

More specifically, the belt 30 is stretched between supporting rolls as two belt supporting members, that is, a drive roll 31 and a steering roll 32 having a belt steering function and a belt tension applying function so as to circulate at a predetermined tension, for example, at 120N.

A pad stay 37 made of, for example, stainless steel (SUS material) is disposed at an inside of the belt 30 corresponding to the inlet side of a nip region between the belt 30 and the belt 13 (upstream side of drive roll 31), and is pressed against the pressurizing pad 18 at a predetermined pressure, for example, at 400 N, thereby forming a nip with the drive roll 31.

The drive roll 31 in the present exemplary embodiment uses a roll which is formed by integrally molding a heat-resistant silicon rubber elastic layer on a surface layer of a core metal of solid stainless steel having a diameter of ϕ18 mm. The drive roll 31 is disposed on an outlet side of the nip region between the belt 30 and the belt 13, and the elastic layer thereof is elastically deformed by a predetermined amount by pressure contact with the pressurizing roll 14.

The steering roll 32 in the present exemplary embodiment uses a hollow roll having an outer diameter of approximately ϕ20 mm and an inner diameter of approximately ϕ18 mm formed of stainless steel. The steering roll 32 serves as a steering roll for adjusting meandering of the belt 30 in the width direction orthogonal to a traveling direction and also as a belt tensioning roll.

Figure 9:
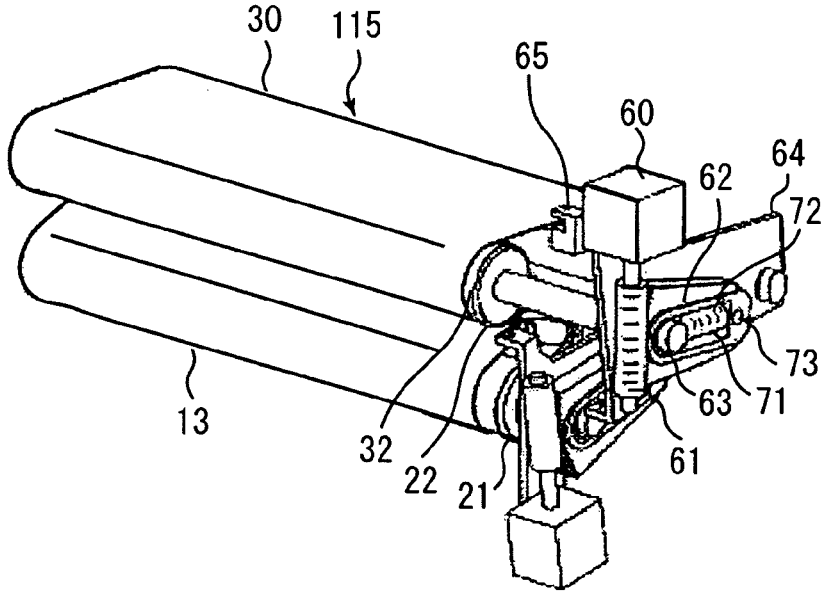
FIG. 9 is a perspective view of the fixing apparatus according to the second exemplary embodiment of the present invention.

As illustrated in FIG. 9, on each end of the steering roll 32 in the belt width direction, the belt flange 22 (second regulating unit) is fixed which prevents a belt position from further moving out of a position at a predetermined distance from a center position of the belt 30. A diameter of the belt flange 22 is larger than a diameter of the steering roll 32. A material used for the belt flange 22 is a plastic member having high heat resistance and high slidability.

In the present exemplary embodiment, the belt 30 is inductively heated by a magnetic field generated by energizing a coil 35 from a third power source 351. A third temperature sensor 83 is provided to measure a temperature of the belt 30. A controller 200 in FIG. 13 turns on and off an output of the third power source 351 according to the temperature detected by the third temperature sensor 83 so that the belt 30 is kept at a predetermined temperature (160° C. in the present exemplary embodiment).

Next, a block diagram illustrated in FIG. 13 will be described below. The controller 200 includes a CPU 201 and a ROM 202 storing a program for the control in the present exemplary embodiment. The controller 200 controls operation of motors and power sources based on signals received from each sensor. When the signals from the second temperature sensor 80 are received, the controller 200 in the present exemplary embodiment performs similar control as the controller 90 in the first exemplary embodiment for the second power source 701 in the present exemplary embodiment.

Any appropriate belt can be selected as the belt 30 as long as the material can be heated by the coil 35 for inductive heating (refer to FIG. 8) and has heat resistance. For example, a belt which is formed by coating a magnetic metal layer such as a nickel metal layer or a stainless steel layer having a thickness of 75 μm, a width of 380 mm and a peripheral length of 200 mm with silicon rubber, for example, having a thickness of 300 μm is used.

For the steering roll 32, the first regulating unit is provided in a similar way as the steering roll 15 in the first exemplary embodiment. More specifically, the steering roll 32 is mounted on a steering roll supporting arm 71 rotatably and slidably in a direction that applies tension to the belt 30 relative to the supporting arm 71. A roll bearing 63 of the steering roll 32 is urged in a direction that applies the tension to the belt 30 by a tension spring 72 which is held by the steering roll supporting arm 71.

The steering roll supporting arm 71 is supported so as to rotate around a shaft 73 which is fixed on an outside of a side plate 64. On an outer periphery of the steering roll supporting arm 71, a fan-shaped gear 62 (refer to FIG. 11) is fixed and engaged with a worm 61 (refer to FIG. 11) which can be rotated by driving of the stepping motor 60.

In vicinity of the end portion of the belt 30, the second deviation sensor 65 is provided to detect the belt end portion. The second deviation sensor 65 uses a sensor capable of detecting five belt positions in the longitudinal (width) direction by a single sensor, in the similar way as the first deviation sensor 59 in the first exemplary embodiment. The controller 200 controls rotation of the stepping motor 60 according to an output of the second deviation sensor 65 to move one end of the steering roll 32 so as to regulate the deviation of the belt 30 in the longitudinal direction.

Figure 10:
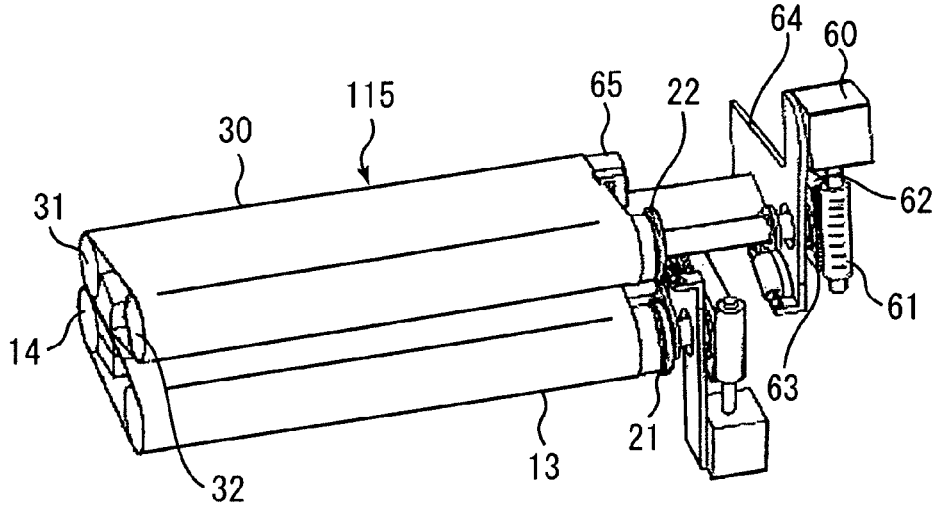
FIG. 10 is a perspective view of the fixing apparatus according to the second exemplary embodiment of the present invention.
Figure 11:
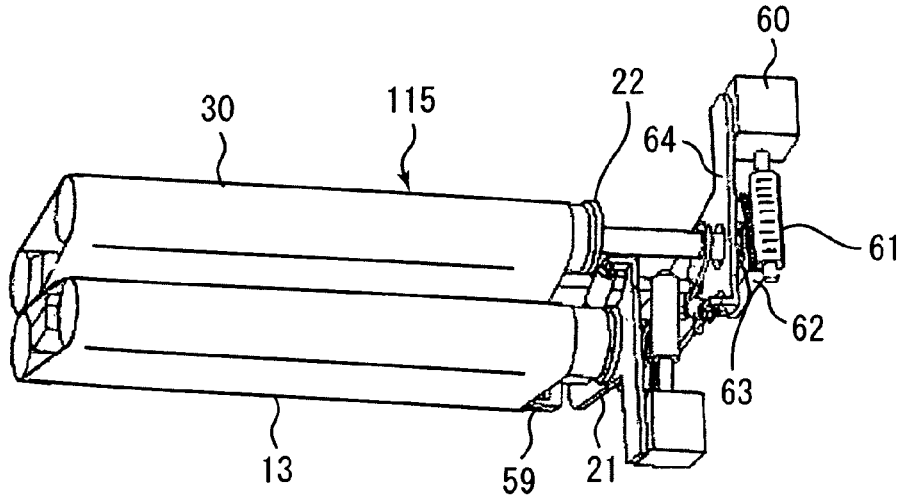
FIG. 11 is a perspective view of the fixing apparatus according to the second exemplary embodiment of the present invention.

FIGS. 9 to 11 illustrate approximately a half of the fixing apparatus in the longitudinal direction. The other half has an exactly symmetrical configuration except for the sensor 65.

Deviation control of the belt 30 by the first regulating unit is similar to the deviation control of the belt 13 by the first regulating unit in the first exemplary embodiment described above. More specifically, by defining belt deviation positions and a relationship of (belt deviation force F)<(belt end portion strength S), belt control can be performed in the similar way as in the first exemplary embodiment.

In the present exemplary embodiment as well, the deviation control of the belt 13 and the belt 30 during the fixing (heating) operation is implemented by the controller 200 which controls the first regulating unit. During the standby operation, the controller 200 controls the belt separation mechanism A to separate the belt 13 from the belt 30. In a state where the belt 13 and belt 30 are separated from each other, the belt 30 rotates and, at the same time, the coil 35 is energized, and the belt 30 is kept at a predetermined temperature (160° C. in the present exemplary embodiment).

Similarly, in the state where the belt 13 and the belt 30 are separated from each other, the belt 13 rotates and, at the same time, the second heater 70 is energized and the belt 13 is kept at a predetermined temperature (100° C. in the present exemplary embodiment). During the standby operation, in the similar way as in the first exemplary embodiment, the controller 200 stops the deviation control of the belt 13 and the belt 30 by the first regulating unit and causes the second regulating unit to regulate the deviations of the belt 13 and the belt 30 by the belt flanges 21 and 22 which come into contact with the end portions of the belt 30 and the belt 13.

As described above, in the present exemplary embodiment, during the standby operation other than the fixing (heating) operation, the belt 13 and the belt 30 are separated from each other and are rotated at a lower speed than during the fixing (heating) operation in order to achieve longer service life.

The deviation control of the belts 13 and 30 by the first regulating unit is implemented only when the both belts 13 and 30 are in contact with each other. When the belts 13 and 30 are separated from each other, the belt flanges 21 and 22 come into contact with the end portions of the belts 13 and 30 to regulate the deviation. Thus, stresses against the belts 13 and 30 can be reduced to achieve the longer service life of the belts 13 and 30. Further, noise generated during start-up of the image forming apparatus or during the standby operation can be suppressed.

The present exemplary embodiment exemplifies a case where two sets of rolls, one set of the drive roll and the steering roll and the other set of the pressurizing roll and the steering roll, suspend respective belts. However, the present invention is not limited thereto and a suspension structure constructed of three or more rolls can provide the same effect.

In addition, the present exemplary embodiment exemplifies a case where the fixing belt flange and the pressurizing belt flange are mounted on the fixing steering roll and the pressurizing steering roll, respectively. However, the present invention is not limited thereto and the flanges may be attached onto the drive roller and the pressurizing roll.

Further, the present exemplary embodiment exemplifies a case where the belt flange is fixed on each end of the steering roll, but the belt flange may be structured to rotate only when the belts come into contact with the flange, that is, to rotate together.

Third Exemplary Embodiment

The exemplary embodiments described above exemplify a fixing apparatus in which belt members are used as first and second regulating units for regulating belt deviation, but the present invention is not limited to a fixing apparatus. For example, the present invention maybe applied to a belt conveyance apparatus which pinches and conveys a member to be conveyed by a belt and a rotating unit which can rotate in contact with an outer surface of the belt. In addition, as the belt equipped with a belt deviation regulating mechanism, for example, an intermediate transfer belt which can contact with and separate from a photosensitive drum as an image carrier for an image forming apparatus may be used. Moreover, where an image carrier is of a belt type, the belt may be an image carrier belt. Furthermore, the present invention may similarly be applied to an image forming apparatus or a display unit which require highly accurate movement of an endless belt.

In any case of the first to the third exemplary embodiments, each one end of the steering rolls 15 and 32 is moved, but both ends of the steering rolls 15 and 32 may be moved to change an inclination of the steering rolls 15 and 32 to regulate the deviation of the belts 13 and 30.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-263026 filed Oct. 9, 2003, which is hereby incorporated by reference herein in its entirety.

What is claimed is:

1. An image heating apparatus comprising:

an endless belt configured to heat an image on a recording material;

a supporting member configured to support the endless belt;

a rotating member configured to contact the endless belt to form a heating nip portion where the endless belt heats the image on the recording material;

a contact/separation unit configured to separate the endless belt from the rotating member;

a first regulating unit configured to regulate a deviation of the endless belt in a width direction by moving at least one end of the supporting member;

a second regulating unit configured to regulate the deviation of the endless belt in the width direction by contacting an end portion of the endless belt in the width direction; and a control unit configured to regulate the deviation of the endless belt in the width direction by the first regulating unit during an image heating operation and to regulate the deviation of the endless belt in the width direction by the second regulating unit without actuating the first regulating unit during a standby operation in which the endless belt rotates in a state that the endless belt and the rotating member are separated from each other.

2. The image heating apparatus according to claim 1, wherein a rotational speed of the endless belt during the standby operation is lower than that during the image heating operation.

3. A recording material conveyance apparatus comprising:

an endless belt configured to convey a recording material;

a supporting member configured to support the endless belt;

a rotating member configured to contact the endless belt to form a nip portion where the endless belt conveys the recording material;

a contact/separation unit configured to separate the endless belt from the rotating member;

a first regulating unit configured to regulate a deviation of the endless belt in a width direction by moving at least one end of the supporting member;

a second regulating unit configured to regulate the deviation of the endless belt in the width direction by contacting an end portion of the endless belt in the width direction; and a control unit configured to regulate the deviation of the endless belt in the width direction by the first regulating unit during conveyance of the recording material and to regulate the deviation of the endless belt in the width direction by the second regulating unit without actuating the first regulating unit when the recording material is not conveyed and the endless belt rotates in a state that the endless belt and the rotating member are separated from each other.

* * * * *